US008596492B2

(12) United States Patent
Lown et al.

(10) Patent No.: US 8,596,492 B2
(45) Date of Patent: Dec. 3, 2013

(54) SYSTEM FOR AIDING THE VISUAL MATCHING OF CONTAINERS HAVING DIVERSE OPENINGS WITH CORRESPONDING LIDS

(75) Inventors: John M. Lown, Huntington Beach, CA (US); Ali Nikkhah, Mission Viejo, CA (US); Ralph R. Hickman, Brecksville, OH (US); Joie L. Puckett, Long Beach, CA (US); Richard K. Jung, Laguna Niguel, CA (US)

(73) Assignee: Snapware Corporation, Hira Loma, CA (US)

( * ) Notice: Subject to any disclaimer, the term of this patent is extended or adjusted under 35 U.S.C. 154(b) by 1150 days.

(21) Appl. No.: 12/161,320

(22) PCT Filed: Feb. 15, 2007

(86) PCT No.: PCT/US2007/004094

§ 371 (c)(1),
(2), (4) Date: Jul. 17, 2008

(87) PCT Pub. No.: WO2007/098031

PCT Pub. Date: Aug. 30, 2007

(65) Prior Publication Data

US 2009/0008284 A1 Jan. 8, 2009

Related U.S. Application Data

(60) Provisional application No. 60/773,948, filed on Feb. 16, 2006.

(51) Int. Cl.
*B65D 43/10* (2006.01)

(52) U.S. Cl.
USPC ..... 220/787; 220/788

(58) Field of Classification Search
USPC ..... 40/310, 311; 215/230; 206/457, 515, 206/459.5; 220/787, 788, 795, 796, 669, 220/324, 326, 659, 801–804
See application file for complete search history.

(56) References Cited

U.S. PATENT DOCUMENTS

| | | | | |
|---|---|---|---|---|
| 3,445,050 | A * | 5/1969 | Friehe et al. | 220/23.88 |
| 3,448,888 | A | 6/1969 | Smith et al. | |
| 3,688,942 | A | 9/1972 | Mitchell et al. | |
| 3,809,284 | A | 5/1974 | Churan | |
| 3,817,419 | A | 6/1974 | Moller et al. | |
| 4,951,832 | A | 8/1990 | Tenney et al. | |
| 5,184,745 | A | 2/1993 | Havens et al. | |
| 5,799,792 | A * | 9/1998 | Abrums | 206/508 |
| 6,729,472 | B2 * | 5/2004 | Stucke et al. | 206/515 |
| 6,793,096 | B1 | 9/2004 | Seok | |
| D512,278 | S * | 12/2005 | Schultz et al. | D7/629 |

(Continued)

OTHER PUBLICATIONS

Notification of Transmittal of the International Search Report and the Written Opinion of the International Searching Authority, or The Declaration, Aug. 6, 2008.

*Primary Examiner* — Steven A. Reynolds
*Assistant Examiner* — King M Chu
(74) *Attorney, Agent, or Firm* — Larry K. Roberts

(57) ABSTRACT

A system for aiding the visual matching of containers having diverse openings with matching lids includes affixing, such as by molding or embossing, geometric planar patterns on the bottom walls of a plurality of rectangular containers having different sized openings and affixing the same geometric patterns to the top wall of the matching lids.

5 Claims, 11 Drawing Sheets

(56) References Cited

U.S. PATENT DOCUMENTS

D512,604 S 12/2005 Panepinto
7,090,089 B2 * 8/2006 Lown et al. ..... 220/324
7,255,228 B2 * 8/2007 Kim ..... 206/320
2004/0060212 A1 * 4/2004 Murphy et al. ..... 40/324
2004/0084464 A1 5/2004 Koo

* cited by examiner

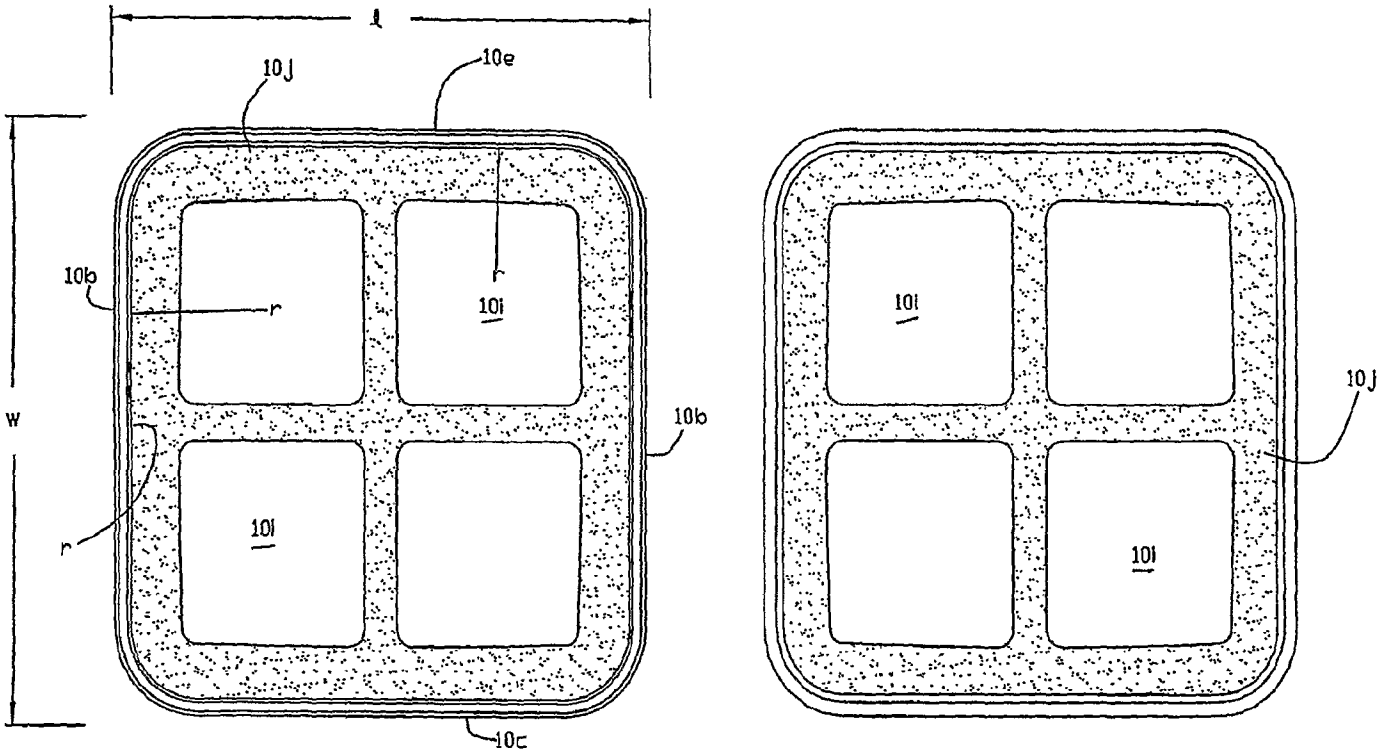
Figure 2
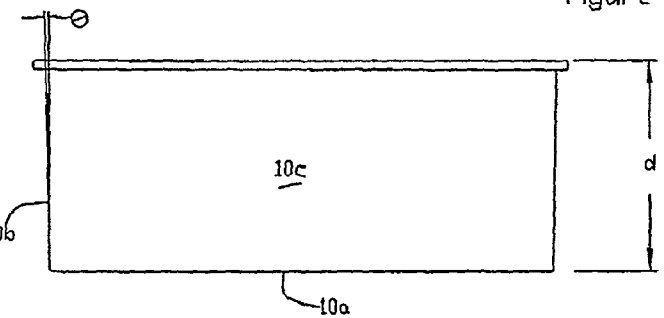
Figure 3
Figure 4

SYSTEM FOR AIDING THE VISUAL MATCHING OF CONTAINERS HAVING DIVERSE OPENINGS WITH CORRESPONDING LIDS

RELATED APPLICATION

This application claims priority based on U.S. Provisional Application Ser. No. 60/773,948 filed Feb. 16, 2006 entitled Container/Lid Combination for Storing Food and Other Articles for all common subject matter. The contents of said provisional application are incorporated herein by reference.

TECHNICAL FIELD

This invention relates generally to open mouth containers for storing food and other items and replaceable lids or covers capable of providing a tight seal.

BACKGROUND ART

System for Aiding the Visual Matching of Containers Having Diverse Sized Openings with Corresponding Lids Containers having different sized openings are generally separated at a storage site from lids which match the openings. As a result finding a matching lid for a particular container can often be a somewhat time consuming and frustrating experience. While it is believed that the same numbers have been used on the containers and matching lids such numbers can be difficult to read and in addition the numbers may detract from or in any event not add to the decorative appeal of the product.

In accordance with this aspect of the present invention a system is provided for aiding the visual matching of one of a plurality of different sized lids with one of a plurality of containers having different sized openings by including a planar geometric pattern, uniquely representative, a particular sized opening on the bottom and top walls of the containers and lids, respectively.

Latching System for Open Top Containers and Sealing Lids

Various types of prior art latching mechanisms have been designed with some of the mechanisms being incorporated into containers/lids available on the market. For example, see U.S. Pat. Nos. 3,688,942 ("'942 patent"); 3,817,429 ("'419 patent"); 6,793,096 ("'096 patent") and publication number US2004/0084464 ("'464 publication"). All of these patents and the publication disclose open top containers with lids which carry a sealing gasket with the gasket being compressed between the upper wall of the container and the lid to provide a seal in the closed condition. A plurality of latches are molded integrally with the lid with each latch having a downwardly extending latch handle with an inwardly and upwardly projecting tab for snapping under an outer skirt or flange extending downwardly from the upper end of the container wall.

The '942 and '419 latching systems, which describe the container as being round or rectangular, use a single locking tab or latching hook formed with each latch handle. The '464 publication and the '096 patent disclose straight sided rectangular containers with a single locking tab ('464 publication) or two elongated protuberances ('096 patent) for engaging a groove formed between the skirt and the upper container wall. A container/lid, marketed under the name Lock & Lock, in the form of a generally rectangular container with appreciably curved side walls has latches formed integrally with the lid, the latches having a single curved locking tab for engaging the lower end of a skirt formed around the upper wall of the container. The curved side walls with the matching lids are wasteful of storage space when stacked side by side.

It has been found that thermoplastic containers (formed of polypropylene or polypropylene/polyethylene co-polymers) that have slight convex walls provide certain advantages over straight wall containers, e.g., the walls of a straight wall container have a tendency to bend inwardly following manufacture degrading the appearance of the container. In addition, it has been found that spaced locking tabs on each latch handle having a curvature matching the container wall curvature provides a latch which is easier to close and open while providing a tight seal.

SUMMARY OF THE INVENTION

To enable a user to readily identify the proper lid, among lids of different sizes, for one of a plurality of rectangular open top containers having different sized openings, the bottom walls of the containers include a geometric pattern, unique to each size of opening, e.g., squares, rectangles or circles. Matching lids are provided with the same geometric patterns on the top wall thereof. For example, one, two, six and three and four squares may be used to represent openings of 4.25"×4.25"; 6.25"×4.25"; 8.5"×6.25"; 9"×4.25"; and 8.5"×5", respectively.

The depths of the containers of any given size of opening may vary so that one lid may fit all of such containers. For example, the depths of the containers bearing two squares may be 2.25", 4.5", 6.75" and 9".

A container/lid combination in accordance with the second aspect of our invention may comprises an open top container having a bottom wall, longitudinal and transverse peripheral walls with the peripheral walls terminating in a generally flat upper sealing surface surrounding the opening. The flat upper sealing surface merges with a down turned peripheral skirt spaced outwardly from the peripheral walls. The peripheral walls are slightly convex with radius of curvature of any one of the walls being with the range of about 40" to 120" and preferably between about 60" to 100".

A generally rectangular lid or cover, for closing the container open top, has a top wall merged with a downwardly extending peripheral skirt with longitudinal and transverse sides and an inner downwardly extending flange with the peripheral skirt and the inner flange bracketing the container upper sealing surface and forming a downwardly facing cavity aligned with the container of the upper sealing surface when the lid is in a closed position.

A removable gasket is disposed within the cavity. At least two latches are molded integrally with the lid with the latches formed on opposing longitudinal or transverse sides, the latches are pivotal about an axis parallel to a tangent to the respective side of the lid. Preferably a latch is formed on each side of the lid. Each latch has a downwardly extending latch handle and at least two spaced inwardly extending locking tabs, in the shape of a reverse J, arranged to snap under the free edge of the container flange to secure and seal the lid to the container. Each locking tab (and particularly its inner surface which engages the skirt) has a curvature matching the curvature of the adjacent peripheral wall and the container skirt.

BRIEF DESCRIPTION OF THE DRAWINGS

FIGS. 2, 3, and 4 are top, bottom and side views, respectively, of the container or vessel of FIG. 1;

DESCRIPTION OF THE PREFERRED EMBODIMENTS

Figure 12:
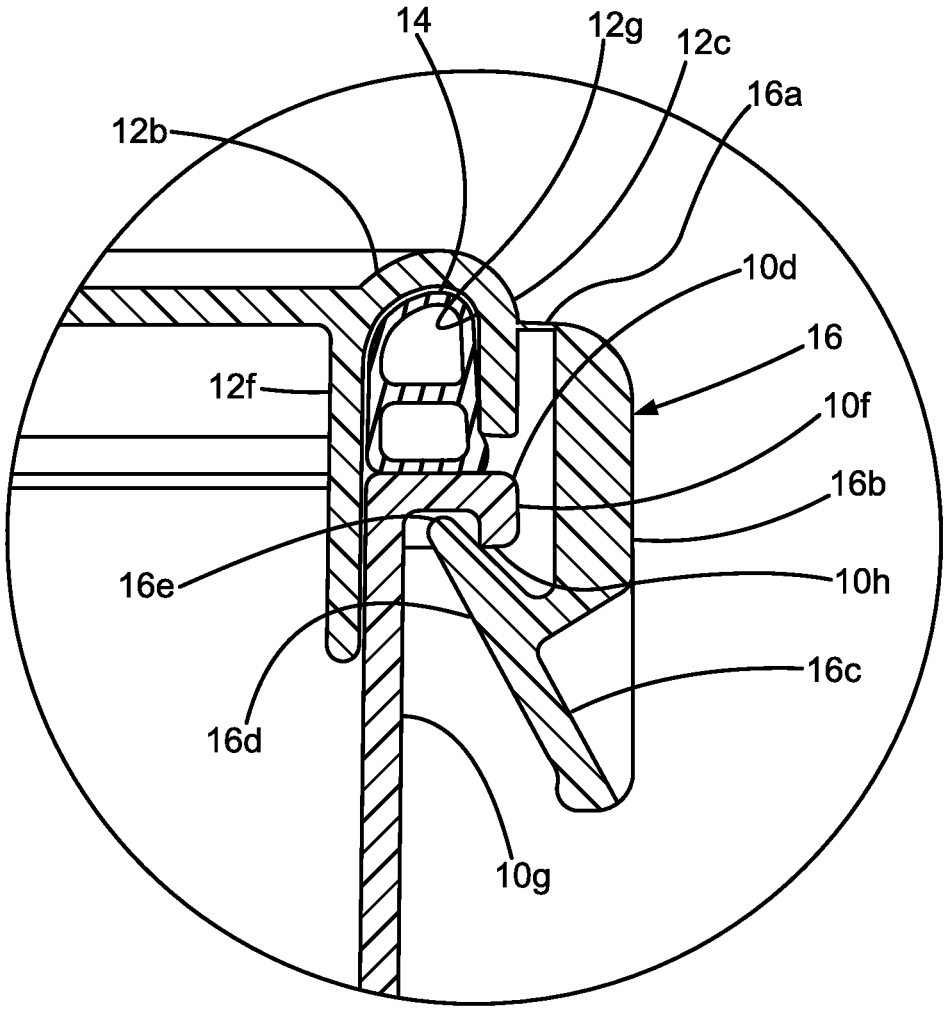
FIG. 12 is a cross-sectional view of a portion of the container wall, skirt, lid, latch and locking tab taken along lines 12 in FIG. 8.
Figure 16:
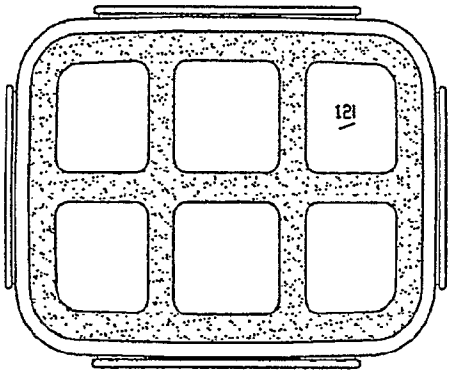
FIGS. 15, 16, 17, 18 and 19 are top plan views of the assembled matching container/lids in which the containers have different sized openings with the lids having unique geometric patterns, e.g., squares correlated to the sizes of the container openings.
Figure 17:
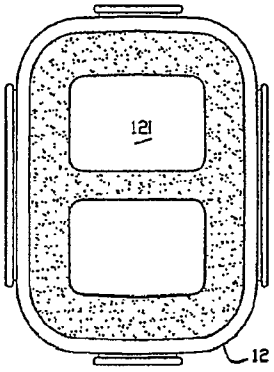
Figure 18:
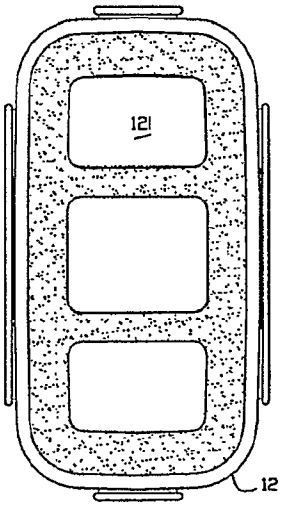

Referring now to the drawings and particularly to FIGS. 1-7, an open top container or vessel 10, molded of a suitable plastic such as polypropylene, polyethylene or other suitable polymers, includes a bottom wall 10*a*, longitudinal and transverse walls 10*b* and 10*c*, respectfully, which intersect at rounded corners 10*d* and extend upwardly to a generally flat peripheral sealing surface 10*e* (FIG. 2). It is to be noted that since the container has a square configuration the length l of the longitudinal walls and the width w of the transverse walls have the same dimension. This is not the case with other rectangular containers as is illustrated in FIGS. 16, 17 and 18 and such illustration is not intended to be limiting. The sealing surface merges with a down turned flange 10*f* (FIG. 12) spaced outwardly from the outer surface 10*g* of the peripheral walls 10*b* and 10*c* as is illustrated in FIG. 12. The flange 10*f* terminates in a free edge 10*h*, which in cooperation with the lid latches and locking tabs serve to lock the lid 12 in place on the container as will be explained.

Referring now, particularly to FIGS. 2, 3, and 4 the bottom wall of the container is provided with a geometric pattern in the form of a four squares 10*i*. The stippled borders 10*j* surrounding the squares is textured (or frosted in appearance) while the squares, as well as the remainder of the container, is clear or translucent. Clear squares inset in the textured boarders adds to the decorative nature of the containers while enabling a user to readily match the container, having a particular sized opening, with a corresponding sized lid having a like number of squares as has been previously discussed. It is to be noted that the geometric patterns illustrated are not limited to squares, but may include circles, etc.

The depth d of the container may vary for each size of opening as was also previously discussed. It is to be noted that the peripheral walls are canted outwardly at a small angle θ, e.g., 1°-7°, depending upon the depth d so that the bottom walls of all containers for each size of opening are the same for stacking purposes. See FIG. 4. This angle θ also allows the container to be readily removed from the mold and permits the empty containers of the same size opening to be nested, thereby decreasing the volume of air required for shipping purposes. See FIG. 13.

In addition, the peripheral walls of the container are provided with a slight outward or convex curve, for example, having a radius of curvature r within the range of about 40" to 120" and preferably within the range of about 60" to 100". This strengthens the peripheral walls and inhibits any inward collapse of the walls. We have found that a radius of about 80" functions quite well.

Figure 11:
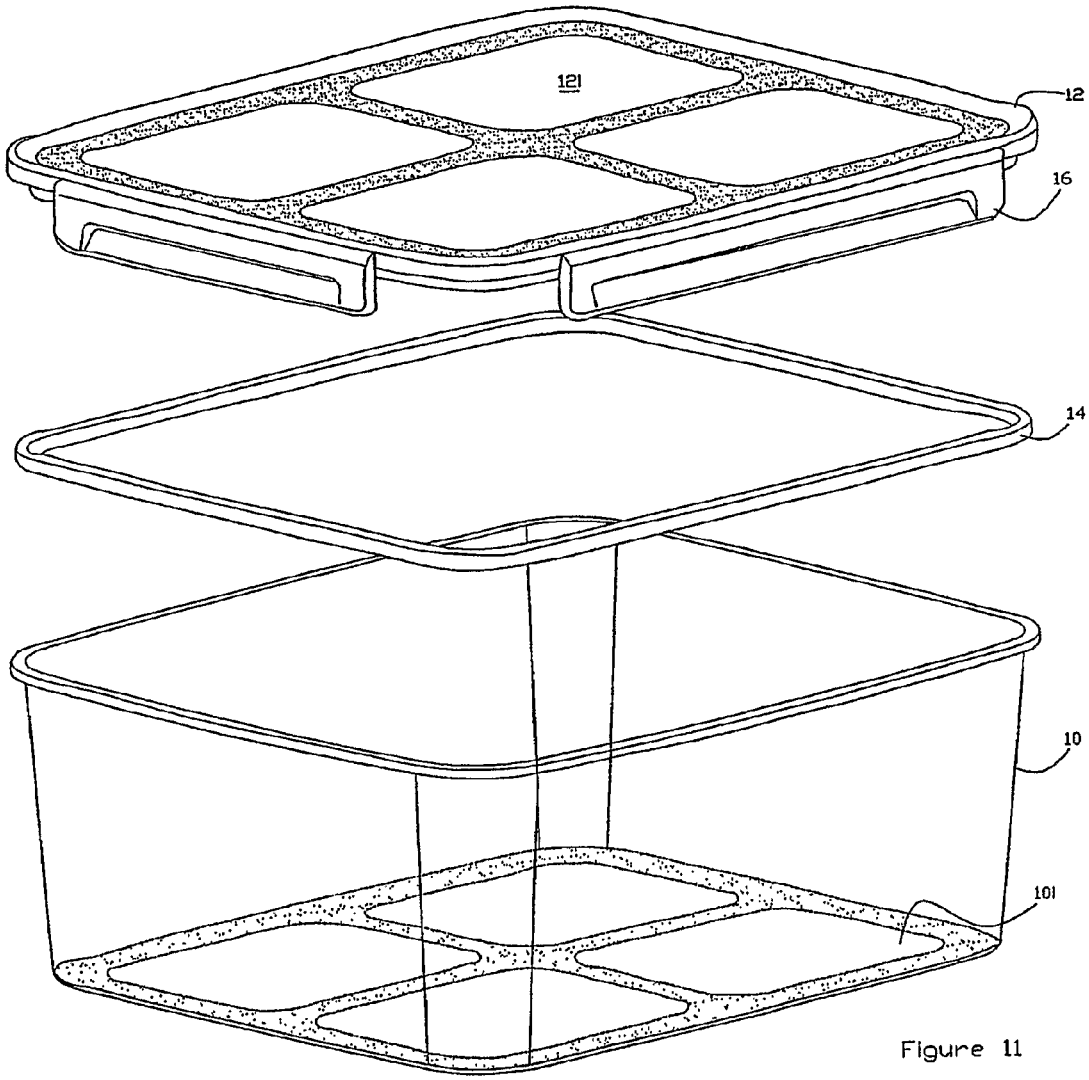

The generally rectangular lid or cover 12, shown in FIGS. 1 and 5-7, includes a top (depressed) planar wall section 12*a* (formed by the squares 12*i* and borders 12*j*) which merges with short upwardly inclined peripheral section 12*b* (FIG. 1) joined to a downwardly extending peripheral skirt 12*c* having longitudinal and transverse sides 12*d* and 12*e*. The lid further includes an inner flange 12*f* (FIG. 7), which with the peripheral skirt 12*c*, brackets the container sealing surface 10*d* and forms a downwardly facing cavity 12*g* for removably retaining a gasket 14 (FIG. 11). The lid inner flange 12*f* extends below the container sealing surface in the closed position to guide the lid onto the container open top. See FIG. 12.

Figure 1:
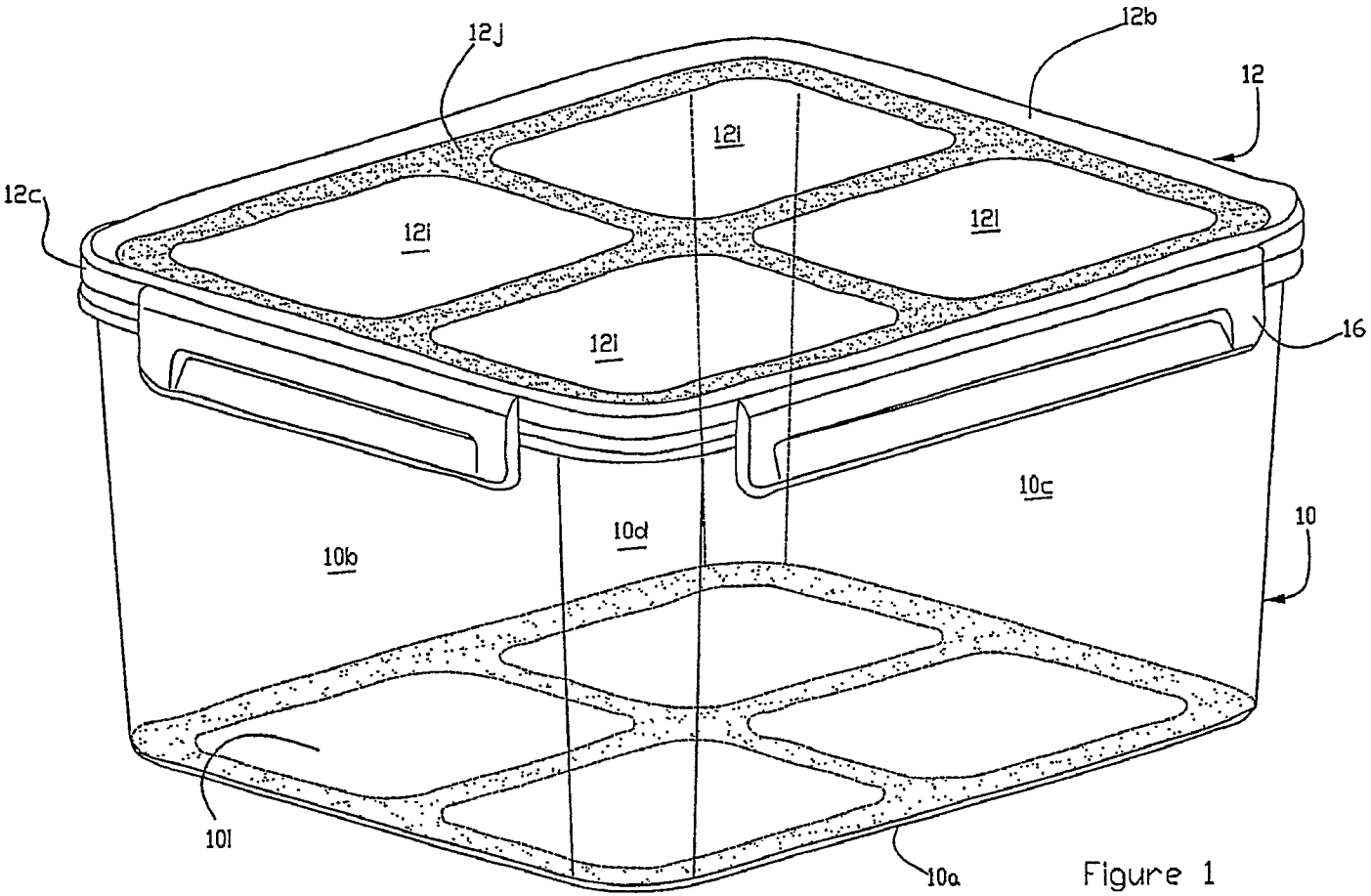
FIG. 1 is a perspective view of a container and lid with the lid in a closed position.
Figure 6:
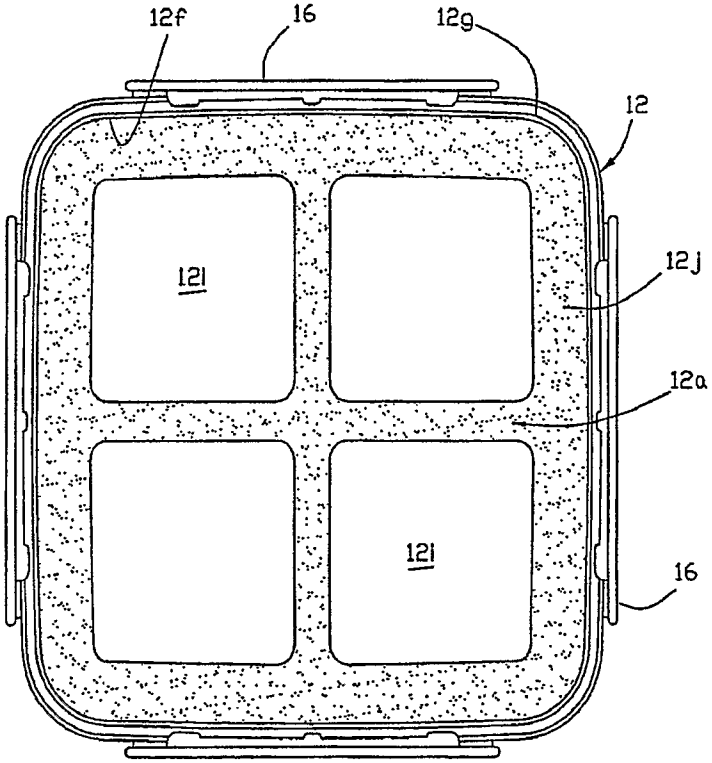
FIGS. 5, 6, and 7 are top, bottom and side views, respectively, of the lid of FIG. 1.
Figure 5:
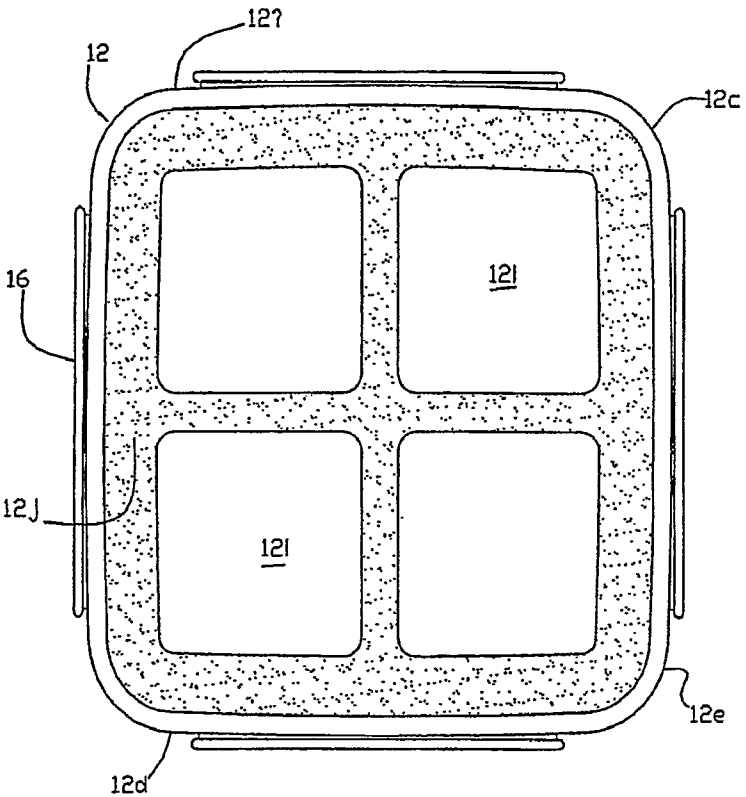
Figure 7:
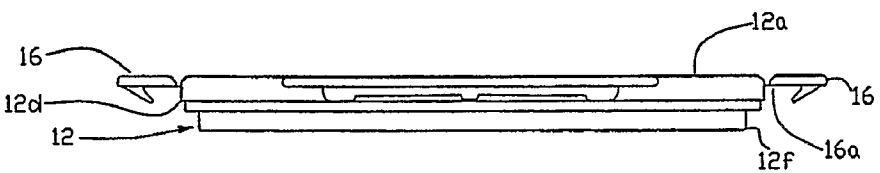
Figure 8:
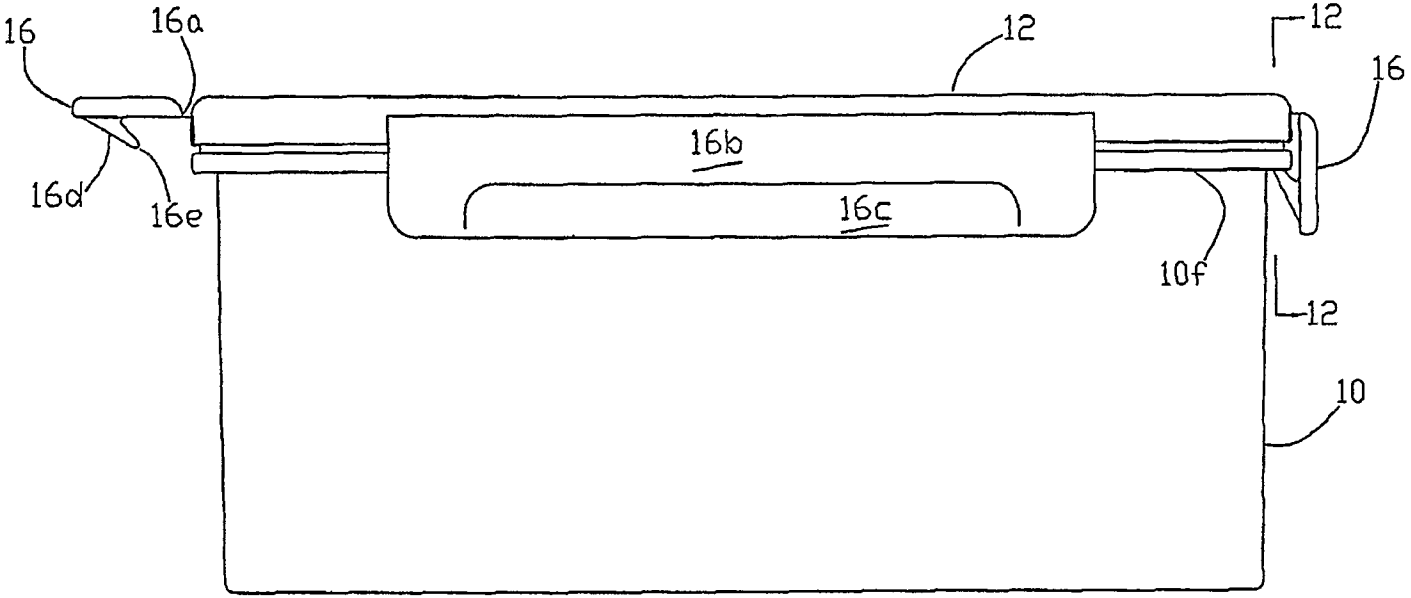
FIG. 8 is a side view of the container/lid of FIG. 1 showing a latch handle in the unlocked (left hand side) and locked position (right hand side)

A latch 16 is molded integrally with the lid on each side thereof with a living hinge 16*a* allowing each latch limited pivotal movement about a hinge line tangent to the center of a respective side, as is illustrated in FIGS. 5 and 8.

The lid top wall is provided with the same geometric pattern of squares 12*i* as the container 10 with a textured border 12*j* extending around the geometrically patterned squares to enable a user to visually (and quickly) select a lid which matches a container of a particular sized opening. The number of squares are correlated to a particular size of opening. For example, four squares may represent a container opening of 8.5"×8.5".

Each latch 16 includes a latch handle in the form of an elongated plate 16*b* with a recessed central section 16*c* and three inwardly and upwardly extending horizontal locking tabs (or fingers) 16*d* terminating in a free end 16*e* (FIG. 8) which snaps under the free edge 10*h* of the container flange 12*c* in the locked position as is illustrated more clearly in FIG. 12. The locking tabs are generally in the form of a reverse letter J.

Figure 9:
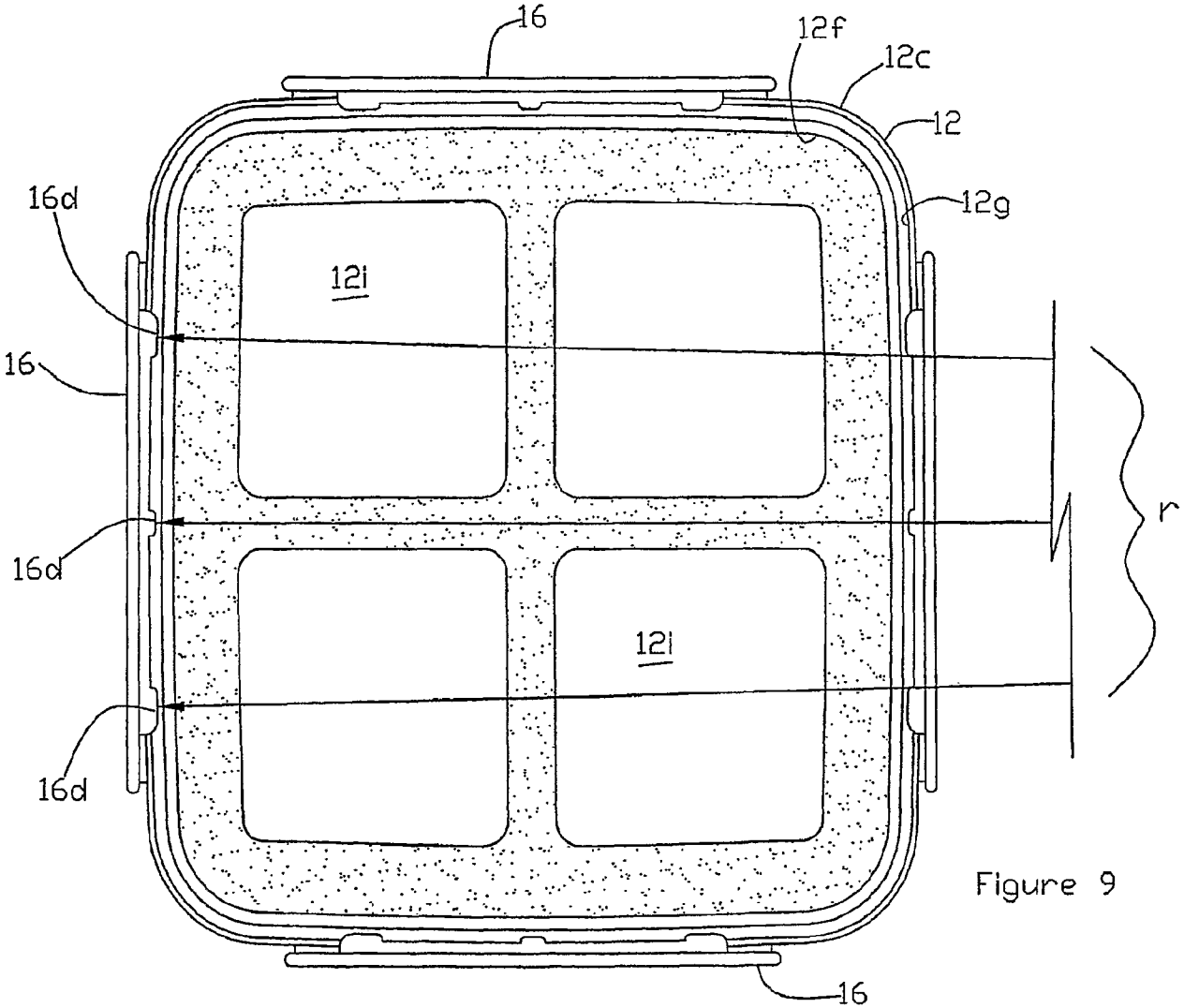
FIG. 9 is a view looking at the bottom of the lid illustrating the slight concave curve formed by the locking tabs.

Referring to FIG. 9, the locking tabs, and particularly the surfaces thereof, which contact and slide under the container flange free edge, are formed along a slight curve having the same radius as the curve of the adjacent flange 10*d* and the container side wall. This curved arrangement and the use of plural lacking tabs on each latch allows the locking tabs to be easily snapped under the removed from the container flange free end.

Figure 10:
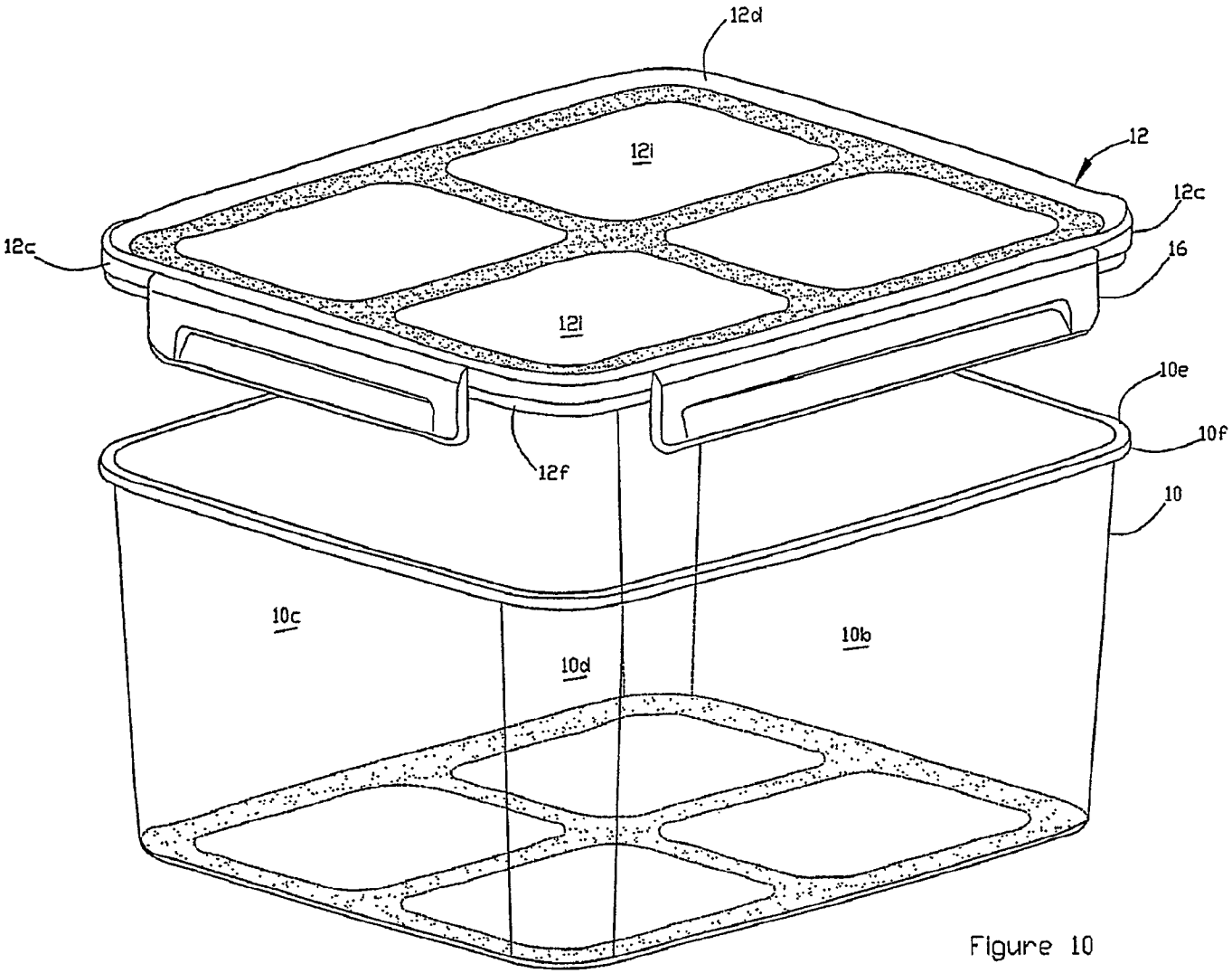
FIGS. 10 and 11 are unassembled perspective views of the container/lid of FIG. 1 with the lid removed and with the gasket separated from the lid, respectfully.

FIGS. 10 and 11 illustrate the lid removed from the container with FIG. 11 also depicting the gasket 14 removed from the lid cavity 12*g*.

As discussed previously, FIG. 12 shows the details of the locking tab 16*d* being secured under the free end of the container skirt 16.

Figure 14:
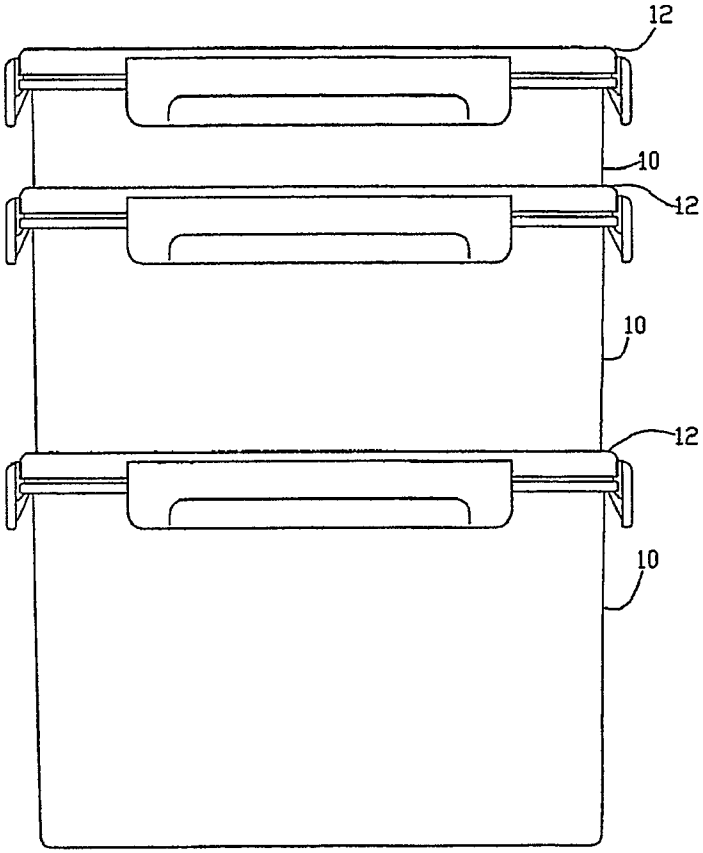
FIG. 14 is a side elevational view of three of the containers with lids in a stacked arrangement.
Figure 13:
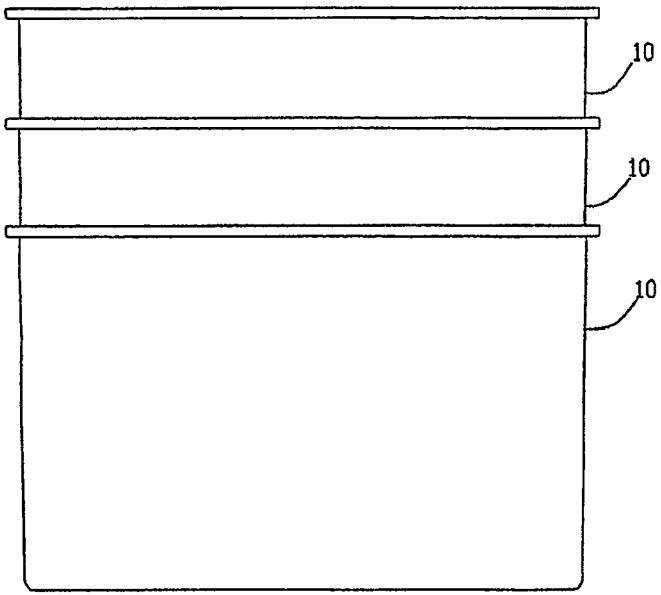
FIG. 13 is a side elevational view of three of the containers in a nested arrangement.

FIG. 13 illustrates several containers in a nested arrangement to minimize storage or shipping space. FIG. 14 illustrates three container/lids in a stacked arrangement with the bottom of one container sitting on the planar top wall of an underlying lid.

Figure 19:
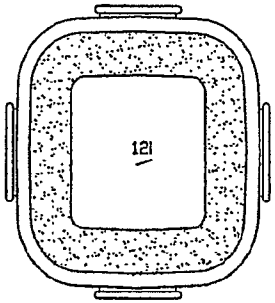
Figure 15:
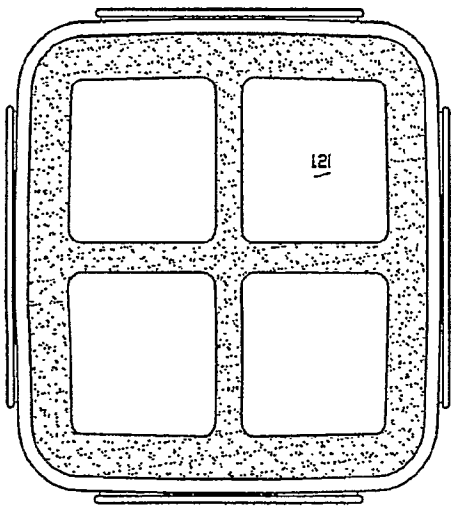
Figure 20:
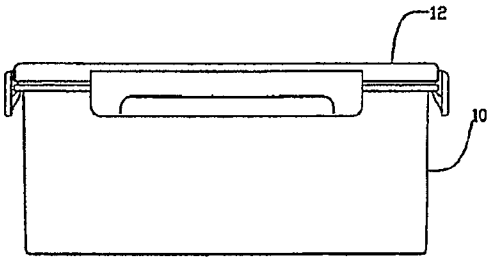
FIG. 20 is a side view of the container/lids of FIGS. 15, 16 and 18.
Figure 21:
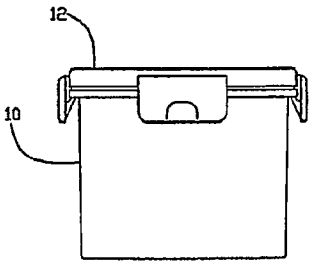
FIG. 21 is a side view of the containers/lids of FIGS. 17, 18 and 19.

FIGS. 15 (reproduction of FIG. 1) and 16 are top plan views of two container/lid combinations of different sized openings with unique geometric patterns, i.e., 12*i* correlated to the size of the openings. FIG. 20 is a side elevational view of either container/lid illustrating identical wall dimensions along two parallel walls and different dimensions along the opposite walls; and FIGS. 17, 18 and 19 are similar to the previous figures again showing container/lid combinations with different sized container openings. FIG. 21 is a front elevational view of the container/lid of FIGS. 17, 18, and 19.

Figure 22:
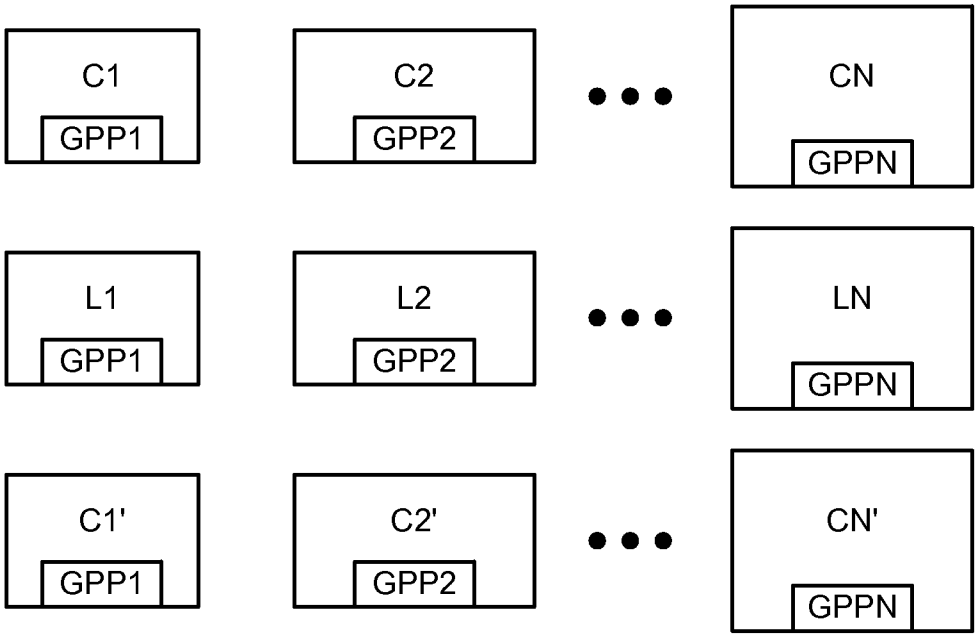
FIG. 22 is a schematic illustration showing a plurality of containers with matching lids and geometric planar patterns.

It is to be noted that, while not shown in FIGS. 15-19, the containers of FIGS. 15-19 have geometric patterns on the bottom walls which match the patterns on the respective lids. FIG. 22 schematically illustrates N container/lid combinations of different sized openings with unique geometric patterns related to the size of the openings. Container C1 has geometric planar pattern GPP1 formed in the bottom wall, and corresponding lid L1 with GPP1 formed in the top wall and sized to match the opening size in C1. Container C1' has the same opening size as C1, and with the GPP1 formed in the bottom wall, but with a different depth than C1. Container C2 has GPP2 formed in the bottom wall, and corresponding lid L2 with GPP2 formed in the top wall sized to match the opening size in C2. Container C2' has the same opening size as C2, and with the GPP2 formed in the bottom wall, but with a different depth than C2. Container CN has GPPN formed in the bottom wall and corresponding lid LN with GPPN formed in the top wall and sized to match the opening size in CN. Container CN' has the same opening size as CN, and with the GPPN formed in the bottom wall, but with a different depth than CN.

As discussed previously the sizes of the container openings, i.e, l and w, may vary as well as the specific geometric pattern representative of a particular sized opening.

There has thus been described a novel container/lid system for storing household items enabling a user to readily match lids with a plurality of containers having diverse openings. Various modifications, and perhaps improvements, to the disclosed embodiments will undoubtedly occur to those skilled in the art without involving any departure from the spirit and scope of the invention as defined by the appended claims.

What is claimed is:

1. A system for aiding the visual matching of containers having diverse openings with corresponding lids comprising:

a plurality of rectangular open top containers having bottom walls and peripheral upstanding walls terminating in different sized openings, the bottom walls of the containers including a geometric planar pattern which is unique to the size of a particular opening; and a plurality of rectangular lids with at least one of the lids sized to match the opening in each container of a given opening size, the matching lid having a geometric pattern on the top wall thereof which corresponds to the pattern on the bottom wall of the corresponding container of the given opening size;

wherein the peripheral walls of each container are canted outwardly at a small angle (θ) of about 1° to 7° so that bottom walls of all containers of the same size of opening are of the same dimensions to accommodate the stacking of the containers;

wherein the peripheral walls of each container are slightly convex following a radius of curvature (r) within the range of about 40" to 120"; and wherein the peripheral walls of the containers terminate in a flat sealing surface and wherein the lids define a downwardly facing cavity following the contour of the sealing surface of the associated containers and further including a removable gasket disposed in the cavity.

2. The system of claim 1 wherein the different sized openings are about 4.25"×4.25"; 6.25"×4.25"; 8.5"×6.25"; 9"×4.25" and 8.5'×8.5".

3. The system of claim 2 wherein the flat sealing surface of each container merges with a down-turned flange spaced from the peripheral walls and further including at least two latches molded integrally with each lid with the latches being pivotal about an axis parallel to tangent to the respective sides of the lid, each latch having a downwardly extending latch handle and at least two spaced inwardly extending locking tabs arranged to snap under a free end of the container flange, each locking tab having a curvature approximately matching the curvature of the adjacent peripheral wall of the associated container.

4. The system of claim 1, wherein each of the containers is molded from a clear or translucent plastic material, and the geometric planar pattern on the bottom wall is defined by borders surrounding each pattern of a textured or frosted appearance, and the geometric pattern surrounded by the borders is clear or translucent.

5. The system of claim 4, wherein the matching lid geometric pattern is formed by a textured-in-appearance border surrounding each pattern.

* * * * *